US005802755A

United States Patent [19]

Tortorici et al.

[11] Patent Number: 5,802,755

[45] Date of Patent: Sep. 8, 1998

[54] RATCHET-LOCKING COLLAR

[75] Inventors: Richard W. Tortorici, Schenectady; Stephen M. Van Dyke-Restifo, Feura Bush, both of N.Y.

[73] Assignee: The United States of America as represented by the Secretary of the Army, Washington, D.C.

[21] Appl. No.: 960,115

[22] Filed: Oct. 27, 1997

Related U.S. Application Data

[60] Provisional application No. 60/034,209, Feb. 5, 1997.

[51] Int. Cl.[6] ..... F41A 25/00

[52] U.S. Cl. ..... 42/75.02; 89/37.11; 403/93; 403/105

[58] Field of Search ..... 42/75.02; 89/37.11; 403/105, 93, 92

[56] References Cited

U.S. PATENT DOCUMENTS

| | | | |
|---|---|---|---|
| 856,575 | 6/1907 | Elliott | 403/105 |
| 1,360,539 | 11/1920 | Laurent | 403/105 |
| 1,563,737 | 12/1925 | Froelich | 89/37.11 |
| 1,994,489 | 3/1935 | Simpson | 42/75.02 |
| 2,345,127 | 3/1944 | Kehne | 42/75.02 |
| 2,610,426 | 9/1952 | Emerson | 42/75.02 |
| 3,790,014 | 2/1974 | Mucsi | 215/9 |
| 4,294,159 | 10/1981 | Wendler et al. | 91/375 A |
| 4,602,890 | 7/1986 | Duda | 403/105 |

FOREIGN PATENT DOCUMENTS

| | | | |
|---|---|---|---|
| 300180 | 9/1932 | Italy | 42/75.02 |

*Primary Examiner*—Stephen M. Johnson
*Attorney, Agent, or Firm*—John Moran; Michael C. Sachs

[57] ABSTRACT

A device that locks a threaded collar around a cylindrical gun barrel has a plunger extending in a radial direction through the collar. The plunger rides upon a series of ratchet teeth, disposed around the circumference of the gun barrel. The ratchet teeth include ramps and steps. As the collar is threaded onto the gun barrel, the plunger rides up the ramp of each ratchet tooth and drops into the step of the next ratchet tooth around the gun barrel. When in place, the plunger is pushed backwards against the wall of the ratchet tooth and arrests rotation of the collar in the unthreading direction. To remove the collar, the plunger is lifted clear of the ratchet tooth. With the plunger held clear of the step of the ratchet tooth, the threaded collar can be unthreaded.

4 Claims, 4 Drawing Sheets

RATCHET-LOCKING COLLAR

This application is a continuation-in-part of application Ser. No. 60/034,209 filed Mar. 5, 1997, now abandoned, the entire file wrapper contents fo which applictions are herewith incorporated by references though fully set forth herin at length.

The invention described herein may be manufactured, used and licensed by or for the U.S. Government for U.S. Government purposes.

BACKGROUND OF THE INVENTION

The present invention discloses a device for locking a collar onto a cylinder. More particularly, the present invention discloses a device for locking a bore evacuator onto a military gun barrel.

Currently, bore evacuators are held in place on a gun barrel by a collar having a ball clutch system. Referring to FIG. 1, a ball clutch system of the prior art comprises a collar 20 surrounding a gun tube 9. Gun tube 9 has gun bore threads 13*a* around the outer circumference of gun tube 9, at the point where collar 20 is to be locked in place. Collar 20 has a straight shaft 21 extending from one point on the outer face of collar 20 to another point on the outer face. Straight shaft 21 touches a third point on the inner face of collar 20, tangential to the outer face of gun tube 9. At each end of the shaft are set screws 22 and 23, respectively. Set screws 22 and 23 provide an environmental seal for the ball clutch system. Between set screws 22 and 23, inside straight shaft 21, lie a spherical ball 24 and a coil spring 25. One end of coil spring 25 contacts an interior face of set screw 22. The other end of spring 25 contacts ball 24. Straight shaft 21 narrows between set screw 23 and the point tangential to the outer face of gun tube 9, so that ball 24 is blocked from travelling further down straight shaft 21 toward set screw 23.

When collar 20 is in place around gun tube 9, both set screws 22 and 23 are tightened. Set screw 22 provides pressure against ball 24 through coil spring 25. When set screw 22 is tightened, ball 24 is locked in place by the narrowed end of shaft 21 at one end, and by coil spring 25 on the other end. Ball 24 contacts gun bore threads 13*a* on gun tube 9, and prevents further rotation of collar 20 around gun tube 9.

To unlock collar 20 and allow removal, set screws 22 and 23 are loosened. Set screw 23 may be completely removed if necessary to access ball 24. When pressure on coil spring 25 is removed, ball 24 may be moved toward set screw 22 and away from gun bore threads 13*a*. Ball 24 may be dislodged by applying pressure from the end of straight shaft 21 nearest set screw 23, if necessary. Once ball 24 clears gun bore threads 13*a*, collar 20 can be removed.

The ball-clutch system was developed approximately 40 years ago and has been used continuously since then. However, the ball-clutch system relies on friction to lock collar 20 against the bore evacuator, and can loosen over time. Further, removal of collar 20 usually requires that the operator disassemble the ball-clutch system, and parts may easily be lost. Finally, the friction caused by ball 24 can cause gun bore threads 13*a* to become distorted, leading to difficulty in removal of collar 20.

OBJECTS AND SUMMARY OF THE INVENTION

It is an object of the present invention to provide a reliable device to lock a bore evacuator onto a military gun tube.

It is a further object of the invention to provide a device to lock a bore evacuator onto a military gun tube which allows easy removal of the bore evacuator.

It is a further object of the invention to provide a device for locking a bore evacuator onto a military gun tube which does not require disassembly of the device to remove the bore evacuator.

It is a further object of the invention to provide a device for locking a bore evacuator onto a military gun tube that avoids distortion of metal threads.

Briefly stated, a device that locks a threaded collar around a cylindrical gun barrel has a plunger extending in a radial direction through the collar. The plunger rides upon a series of ratchet teeth, disposed around the circumference of the gun barrel. The ratchet teeth include Tamps and step areas. As the collar is threaded onto the gun barrel, the plunger rides up the ramp of each ratchet tooth and goes over the lip (30) of the tooth, then drops (steps) down the wall (16) of the tooth, onto the beginning of the ramp (12) of the next ratchet tooth around the gun barrel. This progress over the lip, stepping down along the wall of the tooth onto the beginning (lower) end of the next successive ramp of the next succeeding ratchet tooth, forms a step. When in place, the plunger is pushed backwards against the wall of the ratchet tooth and arrests rotation of the collar in the unthreading direction. To remove the collar, the plunger is lifted clear of the ratchet tooth. With the plunger held clear of the step of the ratchet tooth, the threaded collar can be unthreaded.

According to an embodiment of the invention, there is disclosed a device for locking a collar onto a cylinder against a stop (wall 16), comprising a collar; and means for rotational locking, wherein said means for rotational locking allows rotation of said collar in a first direction urging said collar toward said stop, but blocks rotation of said collar in a second direction opposite to said first direction.

According to another embodiment of the invention, there is disclosed a device for locking a collar onto a cylinder against a stop, comprising a collar; a movable plunger, extending radially through the collar; means for urging the plunger toward the cylinder; the collar including a first threaded portion on an interior surface of the collar; the cylinder having a second threaded portion and a ratchet portion; each of the second threaded portion and the ratchet portion being formed on an external surface of the cylinder; the ratchet portion including a plurality of ratchet teeth; each of the plurality of ratchet teeth including a step area and a ramp; the first threaded portion being in mating engagement with the second threaded portion, wherein rotation of the collar in a first direction around the cylinder urges the collar toward the stop, and wherein rotation of the collar in the first direction causes the plunger to ride up the ramp of one of the plurality of ratchet teeth, and wherein rotation of the collar in a second direction, opposite to the first direction, causes the plunger to step down onto a succeeding of one of the plurality of the ratchet teeth.

According to another embodiment of the invention, there is disclosed a device for locking a collar onto a cylinder against a stop, comprising a collar; a plunger, extending radially through the collar; the plunger having an upper portion; the upper portion of the plunger being at least partially outside the collar; a plug, extending radially through the collar; the plug having a concentric hole; the plunger extending slidably through the hole; a knob, disposed outside the collar; the knob being attached to the upper portion of the plunger; the knob having a lower face movably in contact with an exterior face of the plug; the knob having a depression in an upper face; a knob retainer, affixed to an end of the upper portion of the plunger, the end being outside the collar; the knob retainer fitting into the depression in the upper face of the knob; a coil spring, surrounding the plunger; the coil spring having an end attached to the plunger; and the coil spring having another end in contact with an interior face of the plug, such that the spring biases the plunger toward an interior surface of the collar.

According to another embodiment of the invention, there is provided a method for locking a collar onto a cylinder against a stop, comprising the steps of providing the cylinder with a circumferential ratchet portion; the circumferential ratchet portion including a plurality of ratchet teeth; the ratchet teeth being disposed circumferentially around an exterior surface of the cylinder; providing the cylinder with a first threaded portion, disposed circumferentially around the exterior surface of the cylinder; the first threaded portion being offset longitudinally from the circumferential ratchet portion; the collar including a second threaded portion and means for rotational locking; the second threaded portion being disposed circumferentially around an interior surface of the collar; the second threaded portion being in mating engagement with the first threaded portion; the means for rotational locking engaging the circumferential ratchet portion; and the means for rotational locking allowing rotation of the collar in a first direction urging the collar toward the stop, but blocking rotation of the collar in a second direction opposite to the first direction.

The above, and other objects, features and advantages of the present invention will become apparent from the following description read in conjunction with the accompanying drawings, in which like reference numerals designate the same elements.

DETAILED DESCRIPTION OF THE PREFERRED EMBODIMENT

Figure 1:
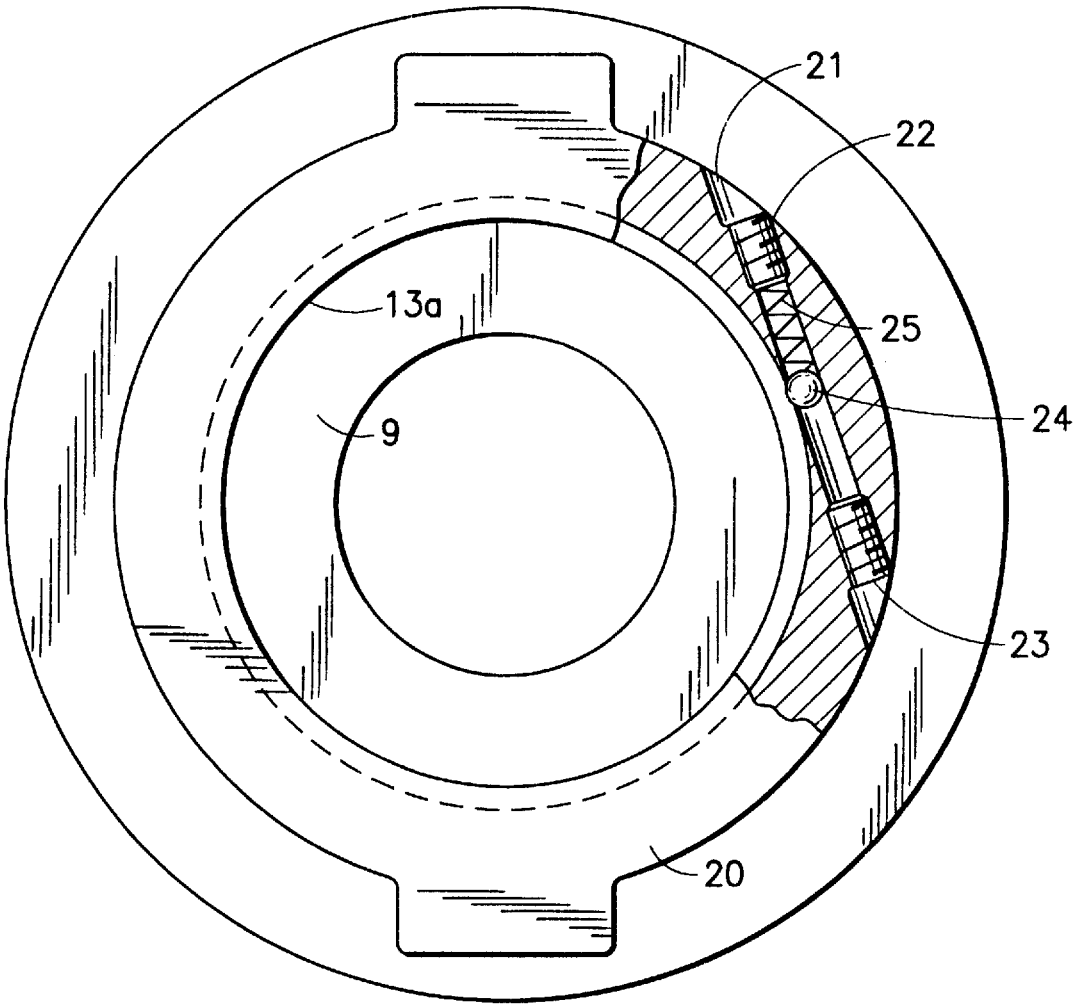
FIG. 1 PRIOR ART
FIG. 1 shows a prior art ball-clutch system for locking a bore evacuator onto a gun barrel.
Figure 2:
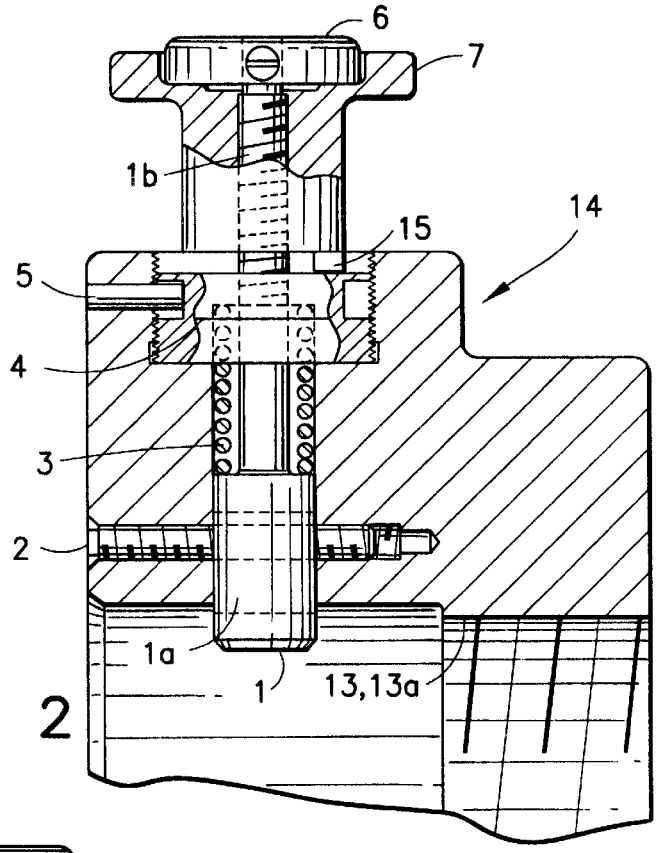
FIG. 2 shows a longitudinal cross-section of the present invention in a locked position.

Referring further to FIG. 2, a threaded plunger 1 of a ratchet-locking collar 14 comprises a plunger portion 1*a* and a threaded shaft 1*b*. Threaded shaft 1*b* ends at a knob retainer 6. The vertical motion of plunger 1 is controlled by the rotation of a threaded knob 7 around threaded shaft 1*b*, and is limited by a plunger retainer 2. A plug 4 holds threaded plunger 1 within ratchet locking collar 14. Plug 4 is held in place by a plug retainer 5. A spring 3 urges threaded plunger 1 toward the gun axis. Rotation of threaded knob 7 is blocked by a locking tab 15, which occupies a slot (not shown) in plug 4 and thereby impedes rotation of threaded knob 7.

A portion of an interior face of ratchet-locking collar 14 is threaded. The threaded portion of the interior face of ratchet-locking collar 14 is distinct from the portion of the interior face through which threaded plunger 1 protrudes. Threaded plunger 1 is offset in a longitudinal direction from the threaded portion of the interior face of ratchet-locking collar 14.

Figure 3:
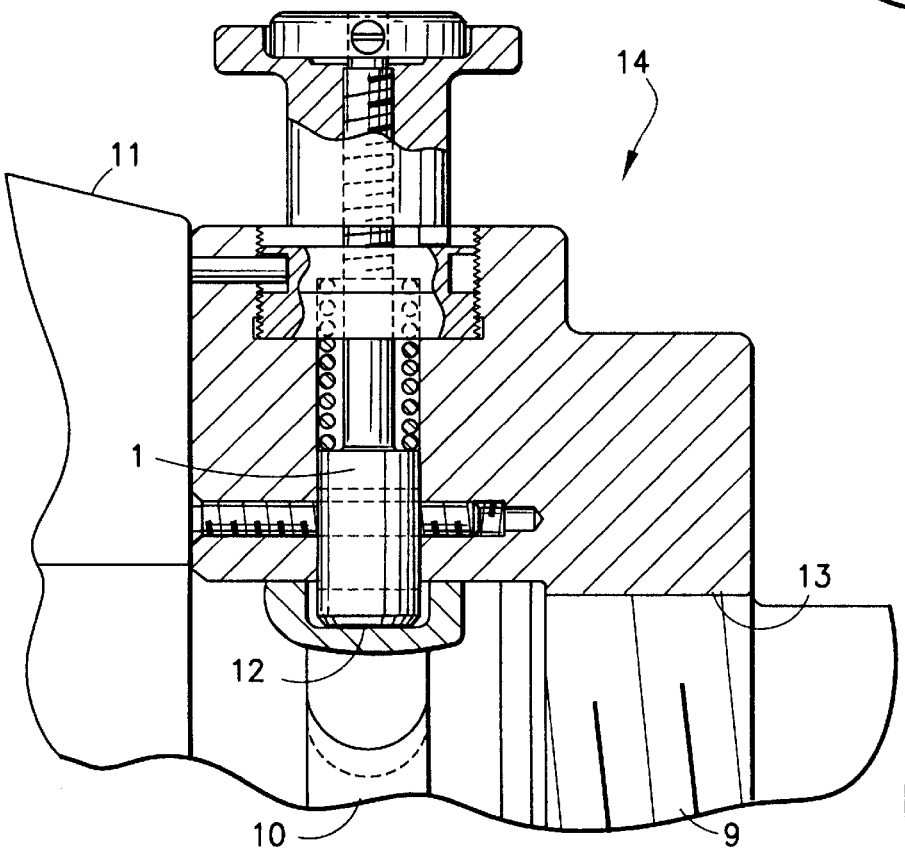
FIG. 3 shows a longitudinal cross-section of the present invention in a locked position in relation to a bore evacuator and a gun tube.
Figure 4:
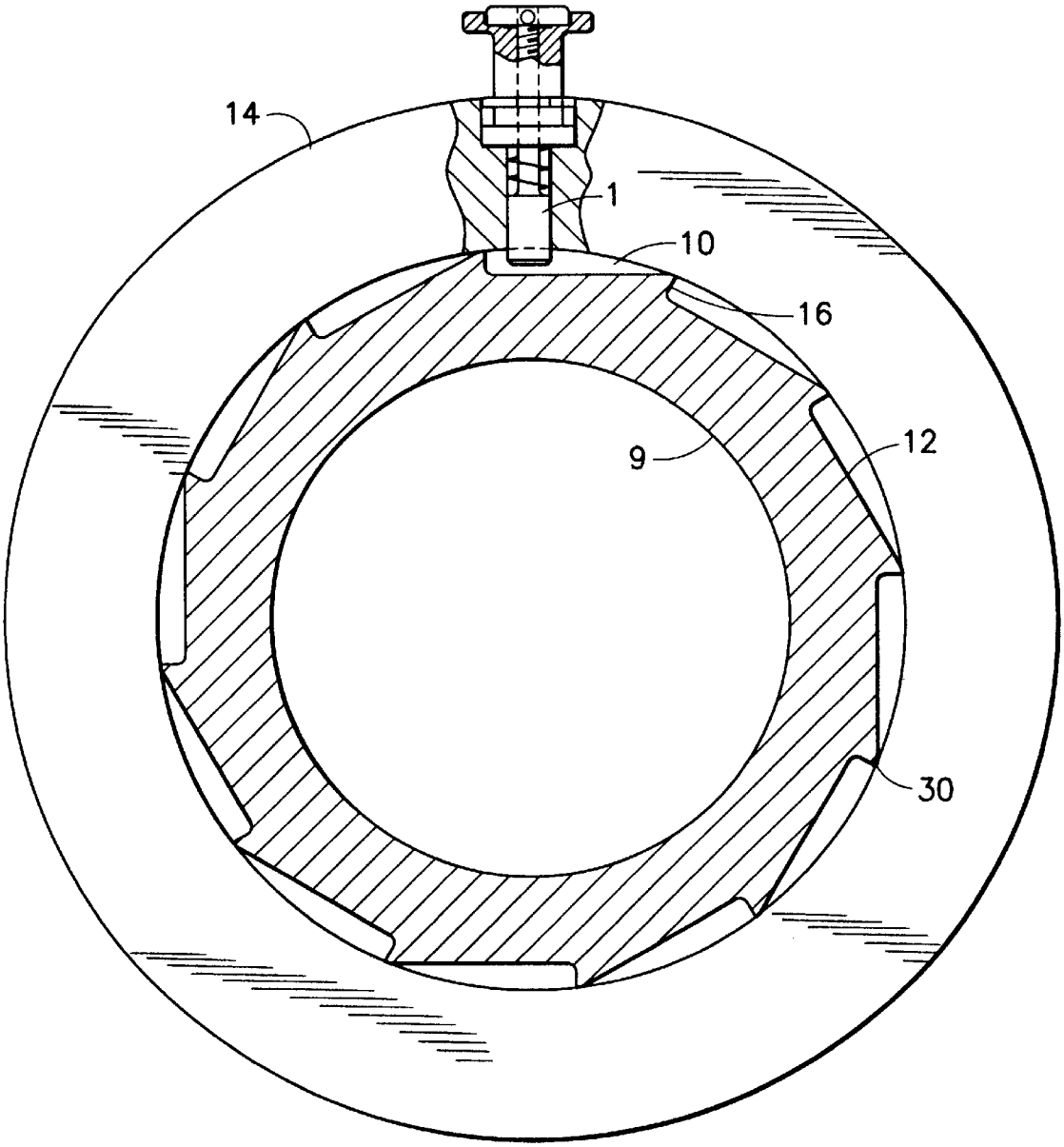
FIG. 4 shows a radial cross-section of the present invention in a locked position.

Referring to FIGS. 3 and 4, the locking mechanism of ratchet-locking collar 14 is engaged when ratchet-locking collar 14 is threaded onto a gun tube 9. The circumference of gun tube 9 includes gun bore threads 13*a*, which match threads 13 on ratchet-locking collar 14. A plurality of ratchet slots 10 are disposed around the circumference of gun tube 9. Ratchet slots 10 lie behind gun bore threads 13*a*, between gun bore threads 13*a* and a bore evacuator 11. Each ratchet slot 10 is connected to the next ratchet slot 10 by a ramp 12, extending from the floor of the first ratchet slot 10 to the lip of a wall 16 of the next succeeding ratchet slot 10.

To operate, ratchet-locking collar 14 is placed around the circumference of gun tube 9 and moved longitudinally along gun tube 9, until threads 13 of ratchet-locking collar 14 engage matching gun bore threads 13*a*. Threaded plunger 1 then engages ratchet slot 10. As ratchet-locking collar 14 is rotated to move collar 14 along gun bore threads 13*a*, threaded plunger 1 slides up each ramp 12 and then over a lip and steps down of the next succeeding ratchet slot 10.

When ratchet-locking collar 14 is at the desired position, threaded plunger 1 occupies one of a plurality of ratchet slots 10. Rotation of ratchet-locking collar 14 in the unlocking direction then pushes threaded plunger up against wall 16 of ratchet slot 10 occupied by threaded plunger 1. So long as threaded plunger 1 remains in a down position, further rotation in the unlocking direction is blocked by the metal-to-metal stop of threaded plunger 1 against wall 16 of ratchet slot 10.

Figure 5:
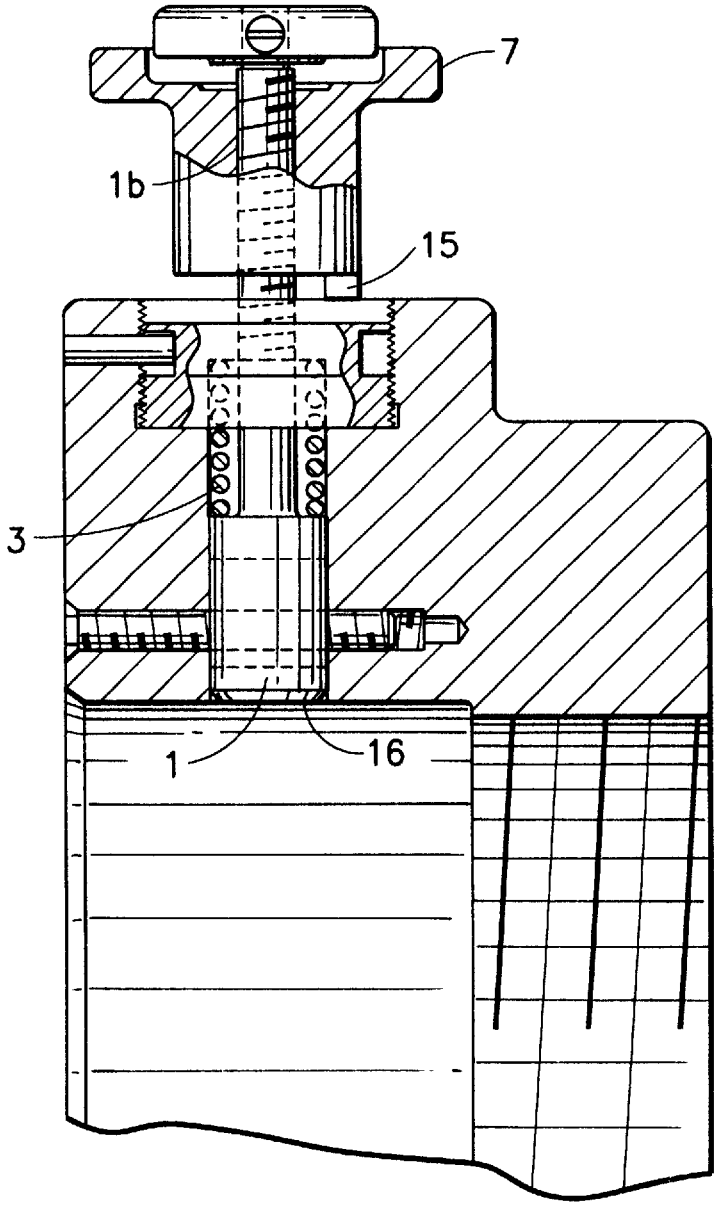
FIG. 5 shows a longitudinal cross-section of the present invention in an unlocked position.

Referring to FIG. 5, unlocking requires threaded plunger 1 be retracted to clear wall 16 of ratchet slot 10. To do so, threaded knob 7 is pulled up against the action of spring 3 so that locking tab 15 clears its slot, and threaded plunger 1 has cleared ratchet slot 10. Threaded knob 7 then is rotated down on threaded shaft 1*b*, thereby holding threaded shaft 1*b* and threaded plunger 1 in an up position. Rotation of threaded knob 7 down on threaded shaft 1*b* continues until threaded plunger 1 has cleared wall 16 of ratchet slot 10. Threaded plunger 1 then no longer blocks rotation of ratchet-locket collar 14 in the unlocking direction, and ratchet-locking collar 14 may be rotated in the unlocking direction for removal.

It is to be appreciated that the current invention allows for additional embodiments in the same spirit as the described embodiment. For example, the spatial location of the locking mechanism and threads 13 of ratchet-locking collar 14 may be reversed, i.e., threaded plunger 1 may be forward of threads 13 of ratchet-locking collar 14. In this embodiment, the spatial relationship of the corresponding portions disposed on the gun barrel also must be reversed, i.e., gun bore threads 13*a* then must be between bore evacuator 11 and ratchet slots 10.

Furthermore, lip 30 of each ratchet slot may be at any level relative to gun tube 9. Where lip 30 is above an exterior surface of gun tube 9, ratchet slots 10 define a plurality of ratchet teeth that function in the same manner as ratchet slots 10. Ramp 12 and wall 16 then form a ratchet tooth.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A device for locking a collar onto a cylinder against a stop, comprising:

a movable plunger, extending radially through said collar;

means for urging said plunger toward said cylinder;

said collar including a first threaded portion on an interior surface of said collar;

said cylinder having a second threaded portion and a ratchet portion, each of said second threaded portion and said ratchet portion being formed on an external surface of said cylinder;

said ratchet portion including a plurality of ratchet teeth, each of said plurality of ratchet teeth including a lip, a wall, and a ramp;

said first threaded portion being in mating engagement with said second threaded portion, wherein rotation of said collar in a first direction around said cylinder urges said collar toward said wall to act as a stop, and wherein rotation of said collar in said opposite direction causes said plunger to ride up said ramp of one of said plurality of ratchet teeth, and to step down over the lip and down the wall of said one of said plurality of ratchet teeth, onto the beginning of the ramp of the next succeeding ratchet tooth.

2. The device according to claim 1, wherein said first threaded portion of said collar is offset longitudinally from said plunger.

3. A device for locking a collar onto a cylinder against a stop, comprising:

a plunger, extending radially through said collar;

said plunger having an upper portion;

said upper portion of said plunger being at least partially outside said collar;

a plug, extending radially through said collar;

said plug having a concentric hole;

said plunger extending slidably through said hole;

a knob, disposed outside said collar;

said knob being attached to said upper portion of said plunger;

said knob having a lower surface movably in contact with an exterior surface of said plug;

said knob having a depression in an upper surface;

a knob retainer, affixed to an end of said upper portion of said plunger, said end being outside said collar;

said knob retainer fitting into said depression in said upper surface of said knob;

a coil spring, surrounding said plunger;

said coil spring having an end attached to said plunger; and said coil spring having another end in contact with an interior surface of said plug, such that said spring biases said plunger toward an interior surface of said collar.

4. The device according to claim 3, wherein:

said upper portion of said plunger is threaded;

said knob is threaded; and said knob is threaded onto said threaded upper portion of said plunger, such that rotation of said knob about said threaded upper portion of said plunger in a first direction urges said knob toward said plug.

* * * * *